US007891736B2

(12) United States Patent
Sims, Jr.

(10) Patent No.: US 7,891,736 B2
(45) Date of Patent: Feb. 22, 2011

(54) INFANT SEAT ROCKER

(76) Inventor: Dewey M. Sims, Jr., 709 Hendrie Blvd., Royal Oak, MI (US) 48067

( * ) Notice: Subject to any disclaimer, the term of this patent is extended or adjusted under 35 U.S.C. 154(b) by 0 days.

(21) Appl. No.: 12/503,833

(22) Filed: Jul. 15, 2009

(65) Prior Publication Data

US 2009/0309400 A1 Dec. 17, 2009

Related U.S. Application Data

(63) Continuation-in-part of application No. 12/214,034, filed on Jun. 16, 2008, now Pat. No. 7,862,118.

(51) Int. Cl.
*A47C 3/02* (2006.01)
*A47D 9/04* (2006.01)

(52) U.S. Cl. ..... 297/260.2; 5/108; 5/109

(58) Field of Classification Search ..... 297/260.2; 5/108, 109

See application file for complete search history.

(56) References Cited

U.S. PATENT DOCUMENTS

| | | | | |
|---|---|---|---|---|
| 3,653,080 | A * | 4/1972 | Hafele | 5/108 X |
| 3,992,731 | A | 11/1976 | Carswell | |
| 4,500,133 | A | 2/1985 | Nakao et al. | |
| 4,616,824 | A | 10/1986 | Quinlan, Jr. et al. | |
| 4,656,680 | A * | 4/1987 | Wilson | 5/108 X |
| 4,722,521 | A | 2/1988 | Hyde et al. | |
| 4,785,678 | A | 11/1988 | McGugan et al. | |
| 4,940,229 | A | 7/1990 | Foster | |
| 5,052,749 | A | 10/1991 | Groenendijk | |
| 5,322,343 | A | 6/1994 | Parker et al. | |
| 5,376,053 | A | 12/1994 | Ponder et al. | |
| 5,378,196 | A | 1/1995 | Pinch et al. | |
| 5,588,164 | A | 12/1996 | Proulx | |
| 5,711,045 | A * | 1/1998 | Caster et al. | 5/109 |
| 6,339,304 | B1 | 1/2002 | Allison et al. | |
| 6,361,446 | B2 | 3/2002 | Lawson et al. | |
| 6,824,473 | B2 | 11/2004 | Wu | |
| 6,908,398 | B1 | 6/2005 | Kang | |
| 7,037,205 | B1 | 5/2006 | Bowman | |
| 7,258,617 | B2 | 8/2007 | Chen | |
| 7,258,619 | B2 | 8/2007 | Tuckey | |
| 7,485,086 | B2 * | 2/2009 | Dickie | 600/28 X |
| 7,551,100 | B1 * | 6/2009 | Salley et al. | 5/108 X |
| 2009/0183310 | A1 * | 7/2009 | Thomas | 5/109 |

* cited by examiner

*Primary Examiner*—Anthony D Barfield
(74) *Attorney, Agent, or Firm*—Mastrogiacomo PLLC

(57) ABSTRACT

An infant seat rocker includes a base member, a motor, the motor being positioned on the base member and a tray member, the tray member being positioned on the base member. Means for attaching the motor to the tray member are also included as well as at least one spring secured to the base member, the spring having a first end proximate a front wall of the tray member and a second end proximate a rear wall of the tray member; and a shaft, the shaft positioned to secure the tray member to the base member. An infant seat is positioned in the tray and the motor is engaged to produce and maintain a rocking motion in the infant seat.

26 Claims, 11 Drawing Sheets

INFANT SEAT ROCKER

CROSS REFERENCE TO RELATED APPLICATIONS

This patent application is a continuation-in-part of U.S. patent application Ser. No. 12/214,034 filed on Jun. 16, 2008 now U.S. Pat. No. 7,862,118, which is hereby incorporated in its entirety by reference.

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to an infant seat rocker and, more particularly, to a mechanized seat rocker that may safely secure an infant seat while inducing and maintaining a gentle rocking motion in the seat.

2. Background Art

There have been a number of devices that have been developed to rock or sway an infant or baby so that the soothing motion may settle or even help the infant or baby to fall sleep. Most notably, rocking cribs have been used for many numbers of years to soothingly rock infants. Cribs are generally sized to allow the infant to stretch out and provide the infant a full range of motion while sleeping. They are large and often are difficult to move. Although cribs can be rocked easily and aid greatly in soothing a baby and helping the baby to fall asleep, because of its size, a crib may be very difficult to travel with each time the family leaves the home for any extended period and, therefore, may be infeasible for the family to rely on a crib for rocking the baby outside the home.

The rocking motion of rocking chairs has also been used as a means of soothing an infant. The gentle rocking motion of a chair while a baby rests in its mother's arms has been used to soothe and help the baby to sleep for many years. As with cribs, rocking chairs are often large and difficult to move easily. Rocking chairs may also be hard to travel with and often times a rocking chair may not be available when a baby becomes agitated. Often a rocking chair may be too large and without enclosures for safely securing a baby while the chair is in a rocking motion. Adults or other responsible individual are needed to safely hold an infant while seated in a rocking chair, thus taking time away from the adult or other individual that could be spent elsewhere.

Swings have been developed to comfortably secure an infant while swinging or rocking the infant. These swings may be rocked manually by a capable individual or theses swings may also be fashioned with a motor or mechanized winding system such that the swing may operate automatically for a period of time. While these swings work well at home, they too are often large pieces and may be difficult and cumbersome to travel with and troublesome to take on short trips to a store or restaurant.

With the advent of infant/child automobile safety seat laws, a number of infant seats have been developed to protect the infant in a vehicle. A number of advances have been made since the first infant seats for vehicles were introduced some years ago. For example, many infant seats have been developed that may have an outer shell with common locating and attaching points so that the seat may be adapted for many different uses. The same seat may be used to secure an infant in a vehicle to a base, used to carry an infant, used to secure an infant in a stroller, or used to place an infant in a swing. Often these infant seats will have a rounded bottom for fitting into a base or stroller to facilitate ease of insertion and removal of the infant seat.

Still another use for the infant seat is to use this same rounded bottom feature for manually rocking the infant in the seat. Often, the mother or other responsible individual may rock the seat manually by placing the seat on the floor and using their hand or foot to rock the seat. While manual rocking of the seat may be helpful in soothing the infant when a crib, chair or swing is not available, the individual may tire or may not be able to maintain a constant rhythmic motion of the seat which may interrupt the soothing aspects of rocking and ultimately disturb the infant.

Therefore, a need exists for an infant seat rocker that is cable of accepting any number of infant seat designs and that can mechanically and consistently rock the seat when the infant is secured in the infant seat. Furthermore, there is also a need for an infant seat rocker that is compact in size, easy to travel with and may be easily set up such that the infant may seamlessly move to a consistent and soothing rocking motion relatively quickly, while providing a level of safety for the seat and the infant.

BRIEF SUMMARY OF THE INVENTION

An infant seat rocker is provided and includes a base member and a motor. The motor is positioned on the base member and the motor is connected to a tray member. The tray member is also positioned on the base member. Means for attaching the motor to the tray member are also included as well as at least one spring secured to the base member, the spring having a first end proximate a front wall of the tray member and a second end proximate a rear wall of the tray member; and a shaft, the shaft positioned to secure the tray member to the base member. An infant seat is positioned in the tray and the motor is engaged to produce and maintain a rocking motion in the infant seat.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
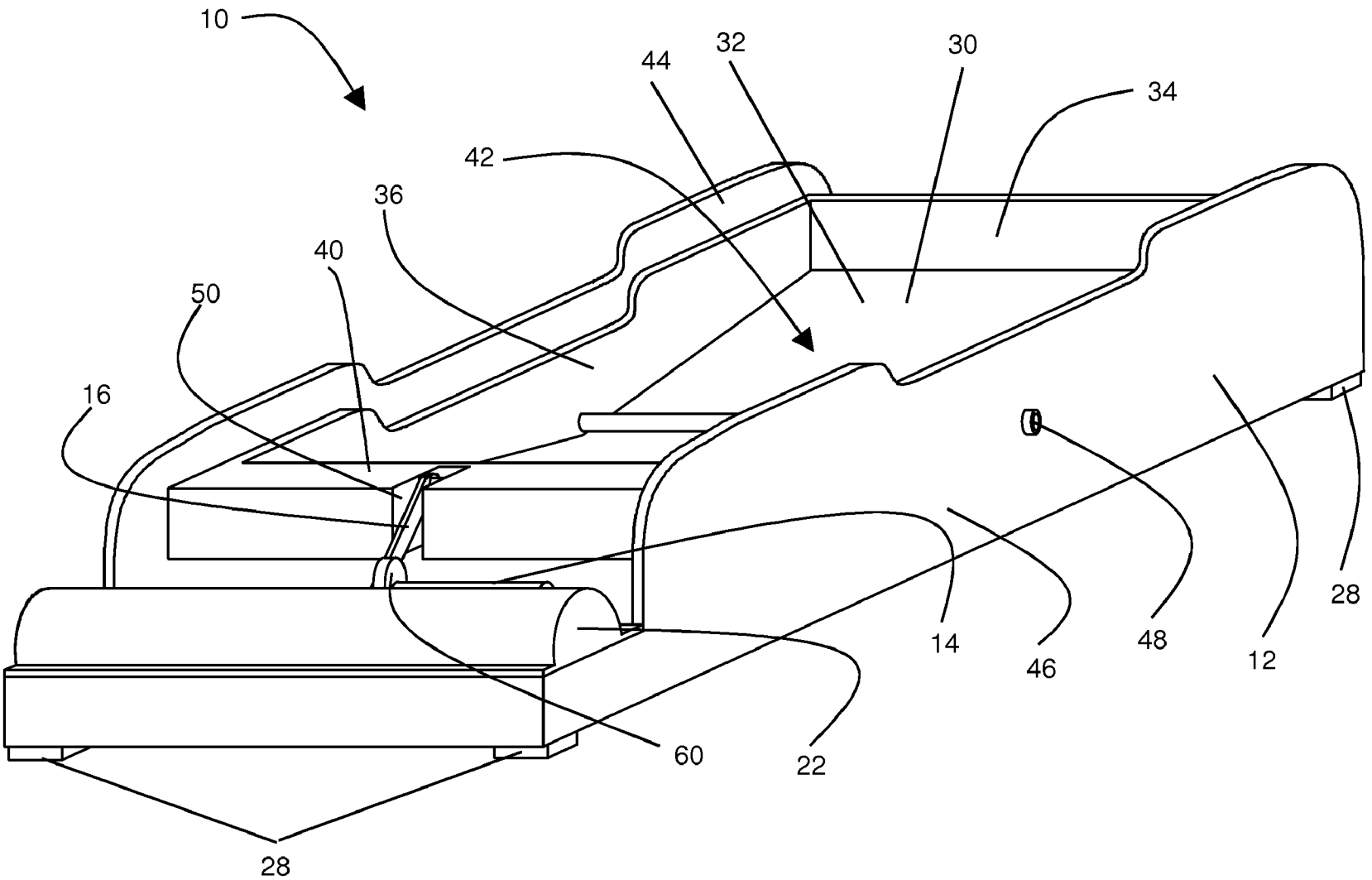
FIG. 1 is a perspective view of an infant seat rocker according to an embodiment of the present invention.
Figure 2:
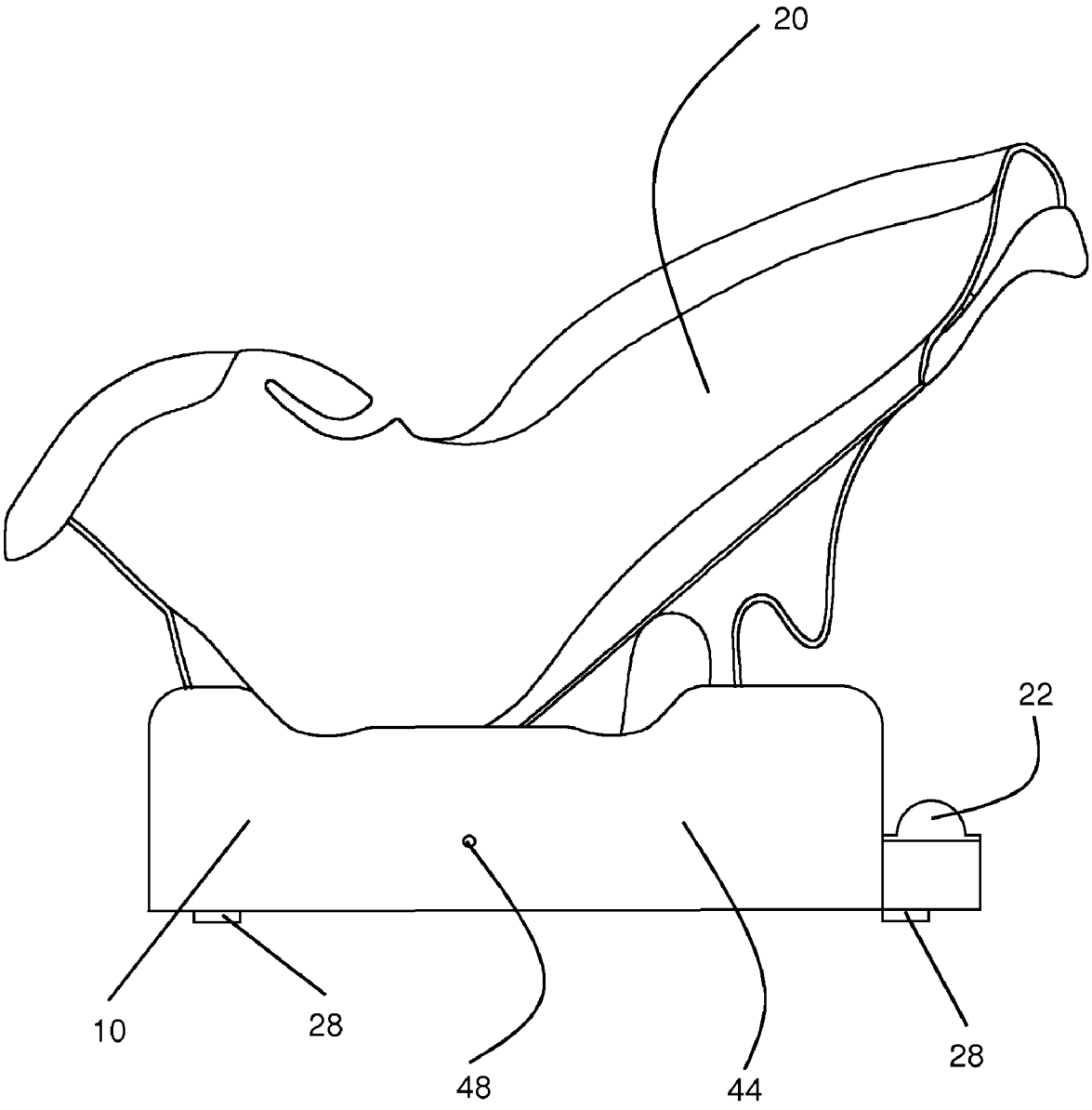
FIG. 2 is a side view of the infant seat rocker according to an embodiment of the present invention.
Figure 3:
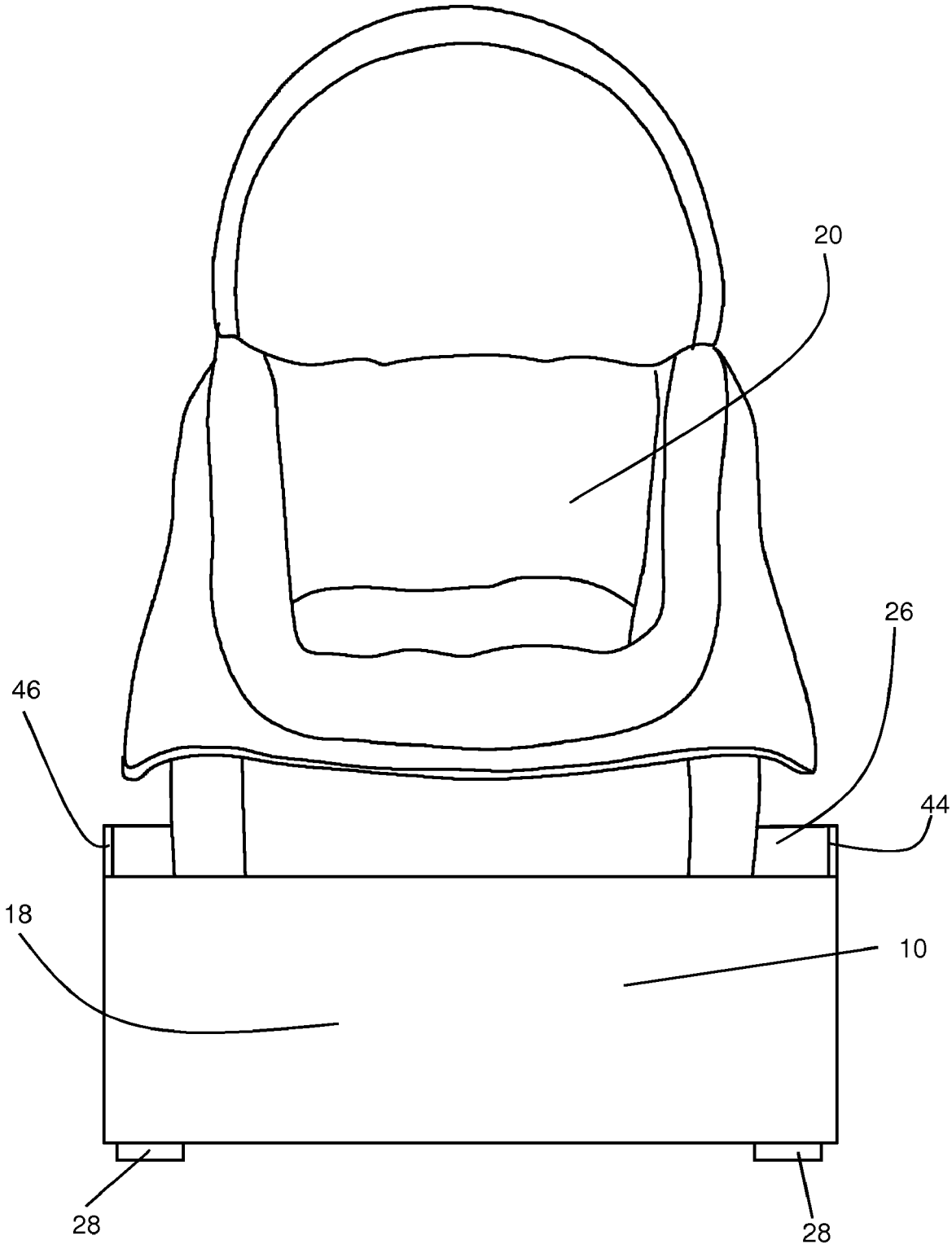
FIG. 3 is a front view of the infant seat rocker according to an embodiment of the present invention.
Figure 4:
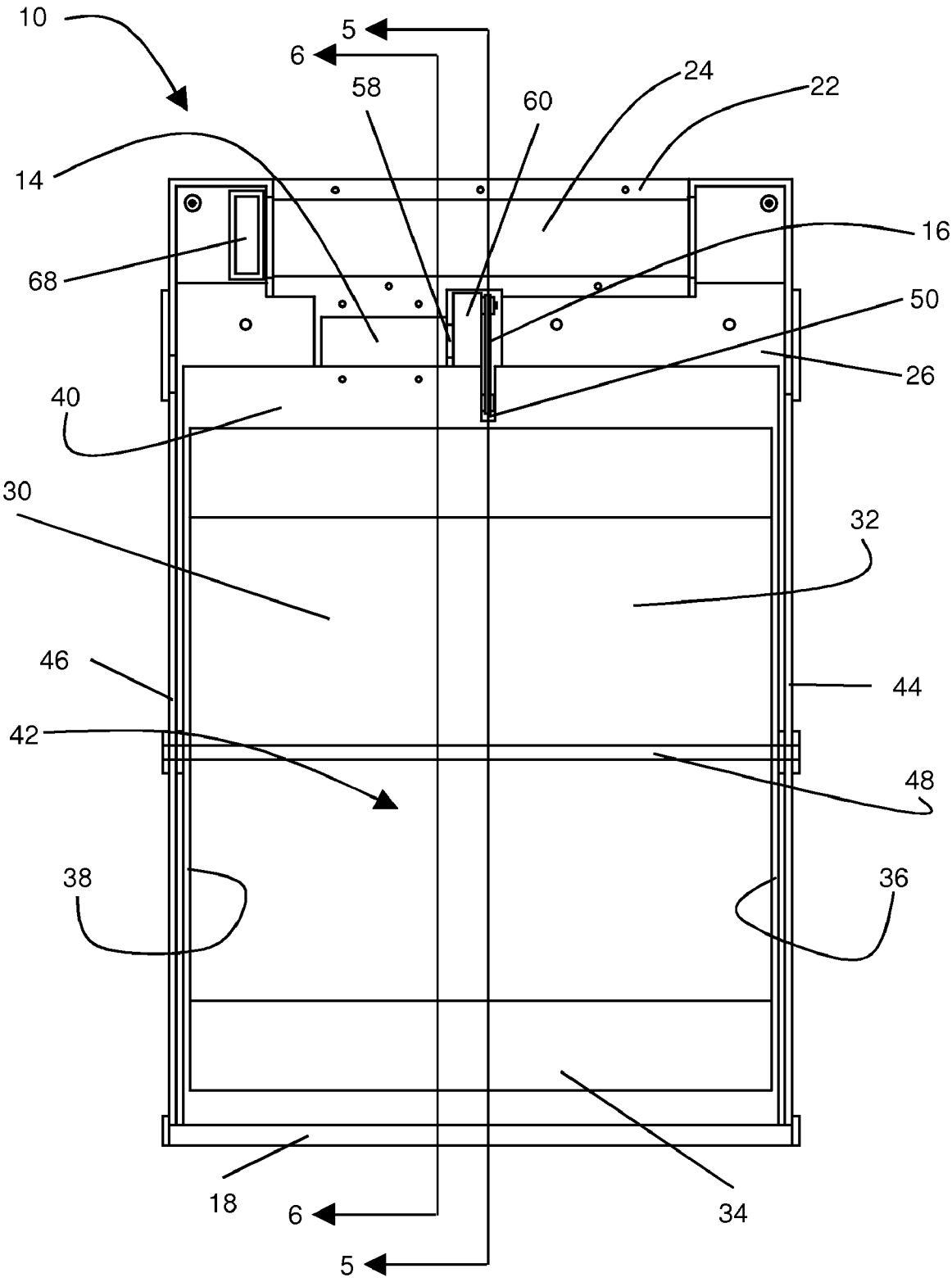
FIG. 4 is a top view of the infant seat rocker according to an embodiment of the present invention.

Referring now to the drawings, a preferred illustrative embodiment of the present invention is shown in detail. Although the drawings represent an embodiment of the present invention, the drawings are not necessarily to scale and certain features may be exaggerated to better illustrate and explain the present invention. Further, the embodiment set forth herein is not intended to be exhaustive or otherwise to limit or restrict the invention to the precise forms and configurations shown in the drawings and disclosed in the following detailed description.

An infant seat rocker 10 is illustrated in FIGS. 1-4 and is used to induce and maintain a rocking motion in and infant seat or carrier 20 when placed in rocker 10. The continuous rocking motion may aid greatly in helping to soothe a tired baby that may be fighting off sleep. Rocker 10 may also aid to keep a resting baby asleep who may have fallen asleep from the motion of riding in a car or baby carriage. The baby resting in seat or carrier 20 may be quickly transferred to rocker 10 with minimal disturbances.

Infant seat rocker 10 includes a support base member 12, a motor 14 and a tray member 30. Base 12 includes a front wall 18 that extends upward and generally perpendicular from base 12. Support base member 12 further includes a housing 22 positioned at the rear of base 12 for enclosing motor 14 and a power supply 24. Base member 12 also includes rear wall 26 that extends upward and generally perpendicular from base member 12. Rear wall 26 may be positioned to enclose motor 14 and power supply 24 with housing 22. Side walls 44, 46 extend upward and generally perpendicular from base member 12. Feet 28 may be included and secured to the bottom of base 12 at at least the four corners. Feet 28 may be made of a rubber material or any other material that will aid to increase the friction between rocker 10 and a surface it may rest on to help prevent rocker 10 from sliding on the surface.

Tray member 30 is fashioned such that seat 20 may be set into tray 30. Tray 30 includes a bottom member 32, a front wall 34 and side walls 36, 38. Tray 30 also includes a rear wall 40. Front wall 34, side walls 36, 38 and rear wall 40 are positioned at the respective ends and sides of bottom 32 and extend outward and generally perpendicular from bottom 32. Front wall 34, side walls 36, 38 and rear wall 40 work cooperatively to form a well 42 to securely capture infant seat 20. Tray member 30 may be sized to accommodate and safely secure any type of infant safety seat designed by any manufacturer to rocker 10. Although the drawings depict infant seat 20 as facing the front of rocker 10, tray member 30 may also be designed such that infant seat 20 may be positioned and secured in tray 30 in either direction to face the front or rear of rocker 10.

Figure 5:
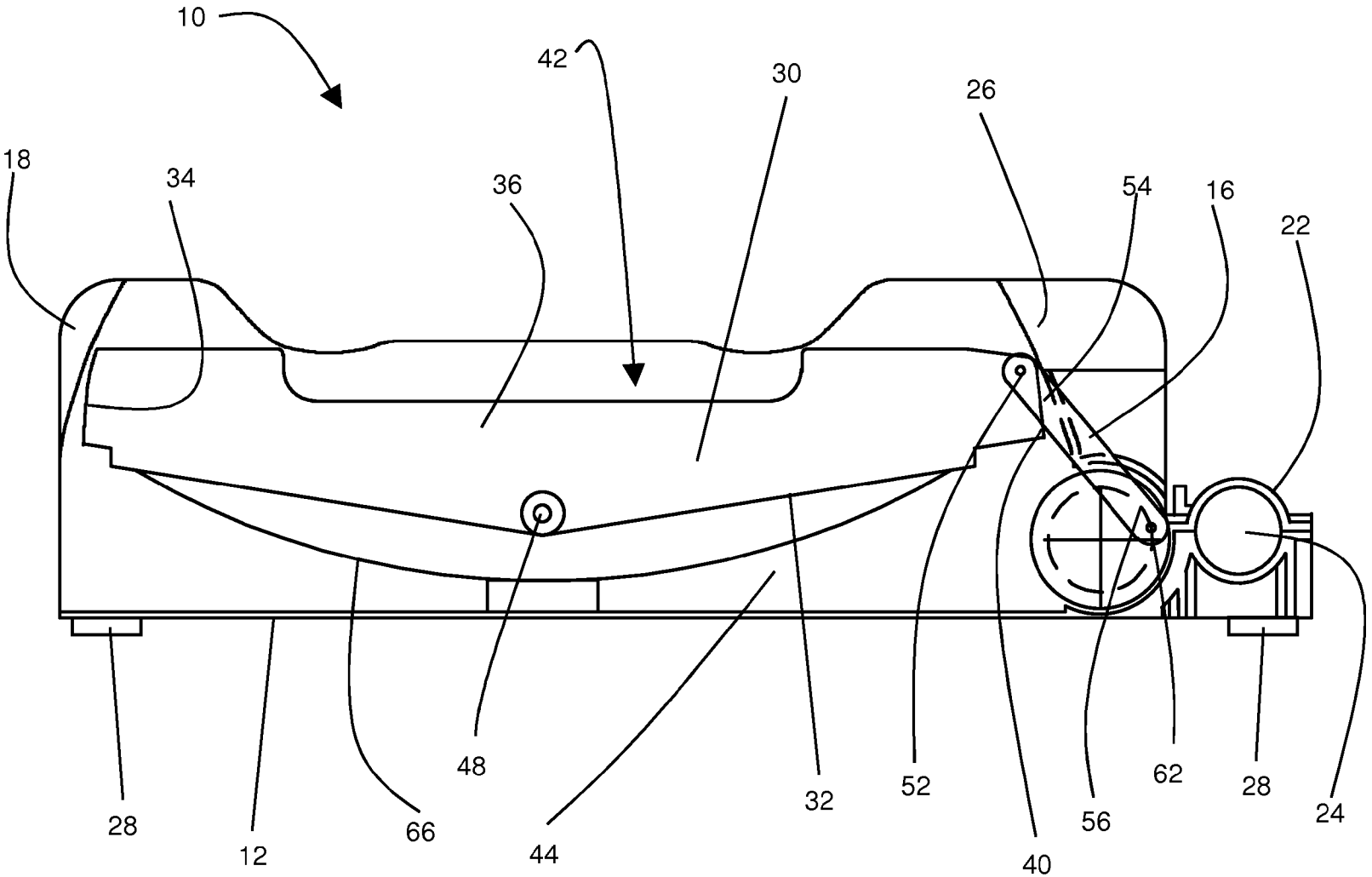
FIG. 5 is a first cross-sectional view of the infant seat rocker illustrated in FIG. 4 according to an embodiment of the present invention.
Figure 6:
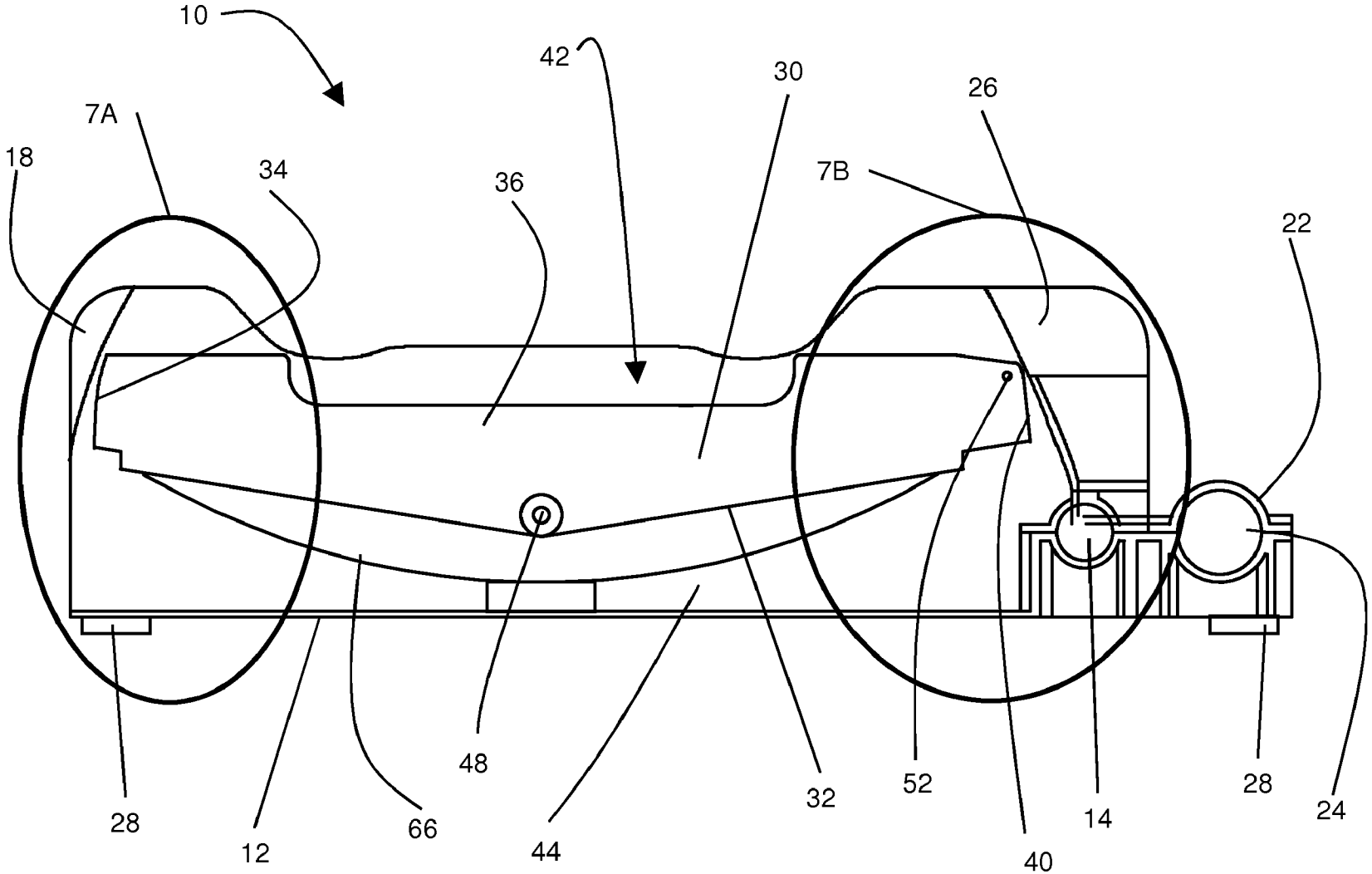
FIG. 6 is a second cross-sectional view of the infant seat rocker illustrated in FIG. 4 according to an embodiment of the present invention.

Now, also referring to FIGS. 5 and 6, Tray 30 may be positioned in rocker 10 onto base member 12, and within front wall 18, rear wall 26 and side walls 44, 46. Bottom member 32 may be angled generally downward from the front and rear ends of bottom member 32 to a midpoint of tray 30. The angling of bottom member 32 toward the midpoint of tray 32 creates a pivot point so that tray 30 may rock fore and aft. Tray 30 may be connected to rocker 10 by a shaft 48. Shaft 48 passes through holes at side walls 36, 38 and the pivot point of tray 30. Shaft 48 passes through holes in side walls 44, 46 and shaft 48 may be secured to base member with any typical fasteners. Shaft 48 secures tray 30 to base member 12, yet allows for tray 30 to rock about shaft 48 and the pivot point of tray 30.

A spring 66 is also provided and extends from near front wall 34 to near rear wall 40 under bottom member 32. In this particular embodiment of the present invention, spring 66 may be fashioned from a flexible piece of metal such as steel and is used to aid the rocking motion of tray 30 relative to base 12. Spring 66 is designed to store energy as the center of gravity of the infant and infant seat 20 fall to a lower height as the center of gravity moves away from the position directly above the pivot point or shaft 48 of tray 30 relative to rocker 10. This stored energy aids in lifting the center of gravity back to the position where the center of gravity will be above the pivot point or shaft 48.

As show in FIGS. 9A-9D, spring 66 will compress and expand with each fore and aft rocking motion. Spring 66 stores energy as it is compressed by the downward motion of tray 30 relative to base 12. The stored energy is released and transferred to tray 30 to aid in propelling the tray as it travels in an upward motion with respect to base 12. Spring 66 may act to dampen any harshness produced by motor 14 and will aid motor 14 in producing a smooth constant rocking motion in tray 30 so that the sleeping baby will not be interrupted.

Although spring 66 is illustrated as a flexible metal that extends the length of bottom member 32, it is important to note that spring 66 may be fashioned in any manner to produce the effect of creating a smooth rocking motion in tray 30. For instance, spring 66 may consist of a number of coiled springs positioned at each of the four corners of tray 30 and base 12 to produce the same smooth rocking motion in tray 30. Irrespective of the configuration of spring 66, spring 66 is also designed and used to allow a smaller motor to be used with rocker 10 as well as to increase the life of the power supply because less energy will be used to rock seat 20.

A bar member 16 is included in rocker 10 and is used to attach tray 30 to motor 14. Rear wall 40 of tray 30 includes a notch 50 that is sized such that a first end 54 of bar member 16 may be inserted freely into notch 50. Rear wall 40 may also include a second shaft 52 that extends between side walls 36 and 38 and is used to secure bar 16 to rear wall 40 of tray 30. Although bar 16 is secured to tray 30, shaft 52 is sized to allow bar 16 to rotate freely about shaft 52. Bar 16 may be manufactured of any type of material including, but not limited to any type of steel, composite or wood material.

Motor 14 is preferably a low rotational speed motor such that a soothing rocking motion may be produced and maintained in seat 20. Motor 14 includes a driveshaft 58 that rotates with the motor. Connected to driveshaft 58 is a hub 60 that also rotates with motor 14. Hub 60 includes dowel 62 that is the connection point for a second end 56 of bar 16. Dowel 62 is positioned on an outer edge of hub 60 and is offset relative to driveshaft 32 of motor 14. The offset of dowel 62 relative to driveshaft 58 causes the end of bar 16 to rotate about driveshaft 58. This rotation of bar 16 about driveshaft 58 will induce a gentle sinusoidal motion in bar 16 that is transferred to tray 30 which forces tray 30 and seat 20 into a rocking motion relative to base 12.

Although the operation of the present embodiment has been described using bar 16, it is important to note; however, that any type of attaching mechanism may be used to connect tray 30 to motor 14. For instance, a coiled spring may also be used. The spring constant of a spring may be such that tray 30 and seat 20 are in a constant continuous smooth rocking motion relative to seat rocker 10 while motor 14 is in operation. The low spring constant rate may allow for motor 14 to have a low start up torque to prevent jostling the infant when motor 14 is initially engaged and tray 30 and seat 20 begin to rock. Tray 30 and seat 20 will begin to rock gently and slowly increase the angle of rocking motion as motor 14 continues to rotate. The speed of motor 14 may be designed to increase the spring force as tray 30 and seat 20 rock rearward and decreases the spring force as tray 30 and seat 20 rock forward. This gentle start of the rocking motion may ensure that the baby remains sleeping when the infant seat is placed in seat rocker 10.

Figure 7A:
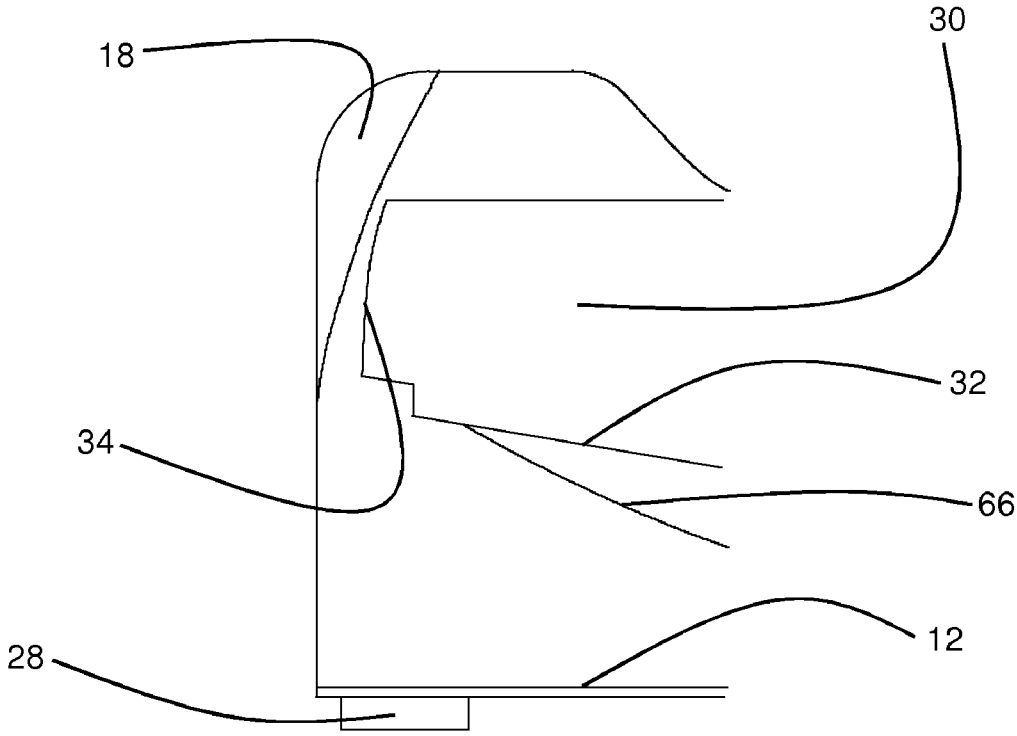
FIG. 7A is an enlarged side view of the front portion of the infant seat rocker as illustrated in FIG. 6 according to an embodiment of the present invention.
Figure 7B:
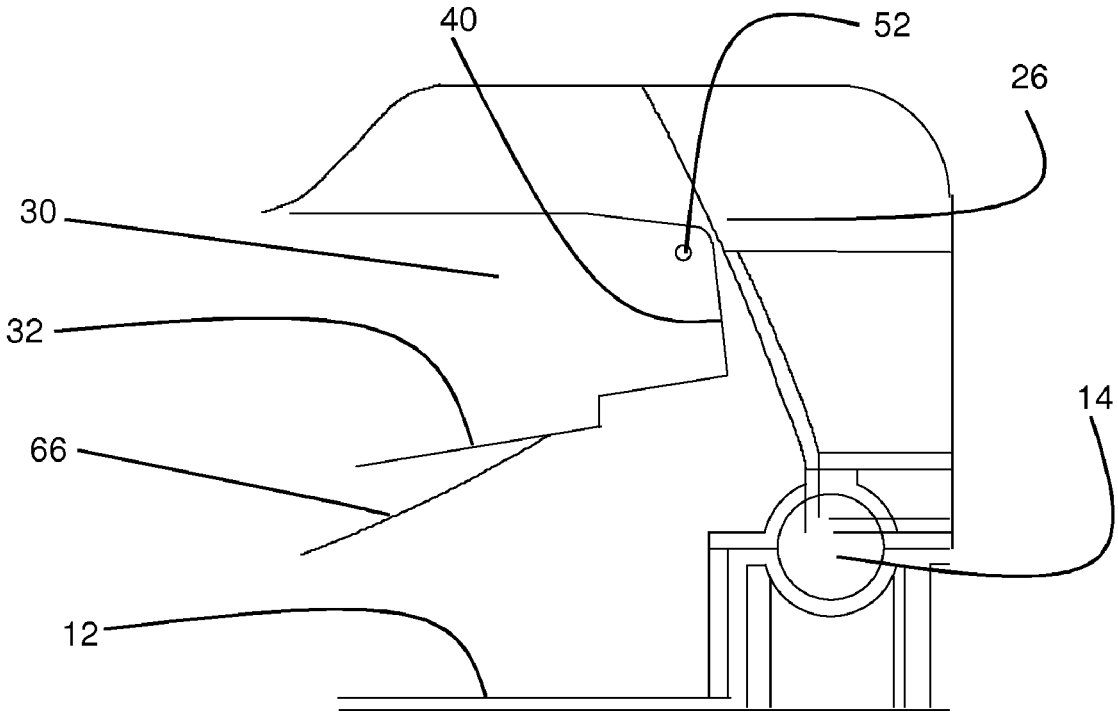
FIG. 7B is an enlarged side view of the rear portion of the infant seat rocker as illustrated in FIG. 6 according to an embodiment of the present invention.

FIG. 7A illustrates an enlarged portion of front wall 34 of tray 30 and front wall 18 of base 12 from FIG. 6. Similarly, FIG. 7B illustrates an enlarged portion of rear wall 40 of tray 30 and rear wall 26 of base 12 from FIG. 6. As illustrated by FIGS. 7A and 7B, the clearances between front walls 18 and 34 and rear walls 26 and 40 are very small. The clearances may be large enough so that any rocking motion of tray 30 with respect to base 12 will not be interfered with by either the front or rear walls 18 and 26, yet the clearances may be small enough such that small fingers, toys or other articles will not become captured between front 34 and 18 and rear 40 and 26 walls of tray 30 and base 12. Similarly, the clearances between side walls 36 and 44 as well as side walls 38 and 46 are also minimized to prevent small fingers, toys, clothing and other articles from being captured between the side walls (see e.g. FIGS. 4 and 8). These small clearances are maintained throughout the rocking motion of tray 30 relative to base 12 as illustrated in FIGS. 9B and 9D (showing tray 30 at its furthest travel relative to base 12).

Figure 8A:
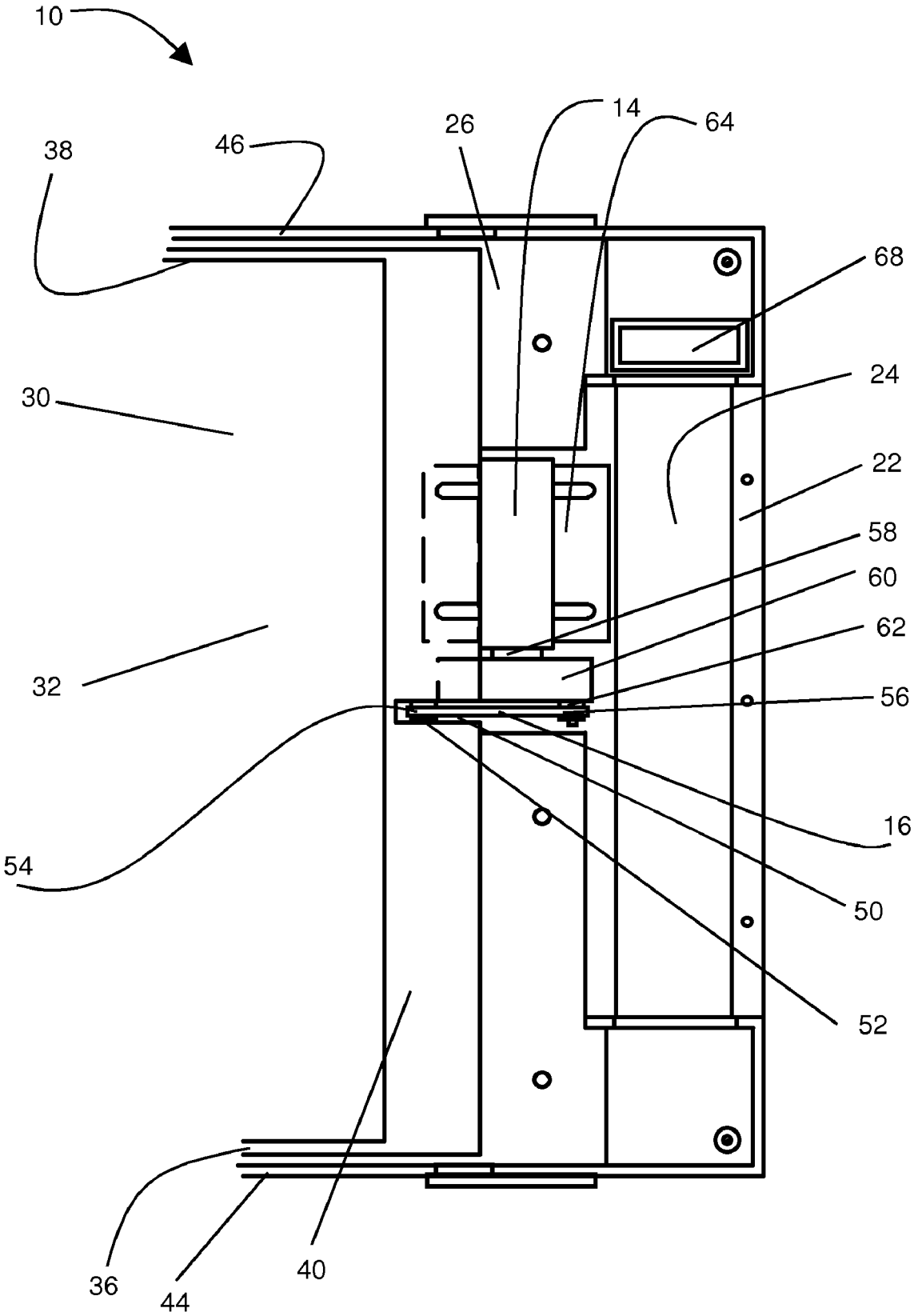
FIG. 8A is an enlarged top view of the rear portion of the infant seat rocker as illustrated in FIG. 4 according to an embodiment of the present invention.

FIG. 8A illustrates infant seat rocker 10 having an adjustable motor mounting slide plate 64. Plate 64 may be secured to base member 12 and motor 14 may be secured to plate 64. Plate 64 includes slots that allow motor 14 to be secured in any forward or rearward position relative to base member 12. When motor 14 is positioned forward on plate 64 relative to base 12, the rocking arc of tray 30 and infant seat 20 relative to rocker 10 is reduced. If motor 14 is positioned rearward on plate 64 relative to base 12, the rocking arc of tray 30 and infant seat 18 relative to rocker 10 in increased. The smaller rocking arc may be preferred for smaller infants. The rocking arc may be increased, as described above, as the infant grows older to produce a larger arc.

Figure 8B:
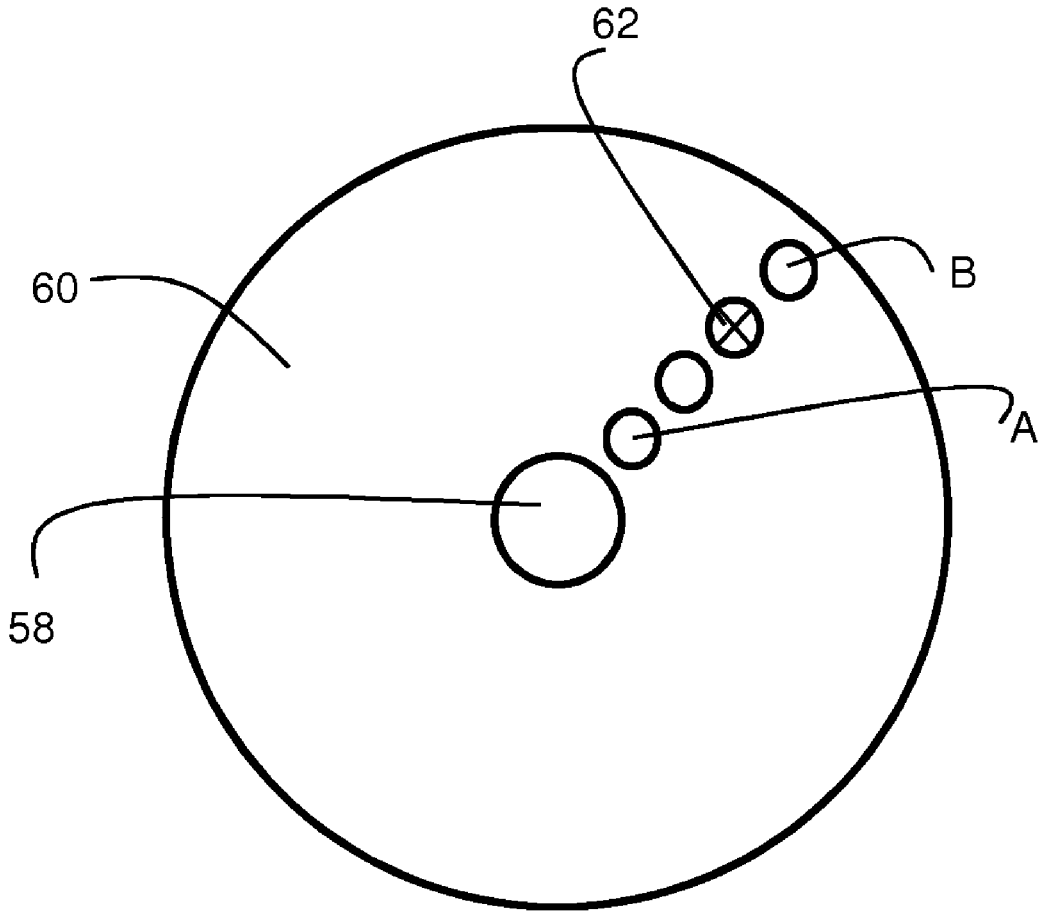
FIG. 8B is an enlarged side view of a hub, a driveshaft and a dowel of the infant seat rocker according to another embodiment of the present invention.

Alternatively, as shown in FIG. 8B, the position of dowel 62 may be changed about hub 60 with respect to driveshaft 58 to also alter the rocking arc of tray 30 relative to base 12. In this particular embodiment of the present invention, hub 60 may include a number of holes along a radius of hub 60 from an edge to center of hub 60 and driveshaft 58. These holes may be used to position dowel at any point along the radius of hub 60. Decreasing the centerline distance between dowel 62 and driveshaft 58 by positioning dowel 62 at hole A will reduce the rocking arc of tray 30 relative to base 12. Increasing the centerline distance between dowel 62 and driveshaft 58 by positioning dowel 62 at hole B will increase the rocking arc of tray 30 relative to base 12. As described above, the smaller rocking arc may be more soothing to a smaller infant and the rocking arc may be increased as the infant grows older and increases in size.

Housing 22 is sized to enclose a power supply 24 for motor 14. The power supply may be of any type suitable to operate motor 14 including batteries or other type of chemical energy. Alternatively, the power supply may also be provided by plugging into a typical wall socket (for example, 110 volt 60 Hz in the United States and 220 volt 50 Hz in many European countries) or vehicle power socket (i.e. vehicle cigarette lighter). A switch 68 is provided so that the power to motor 14 of seat rocker 10 may be turned on and off. Still another means of operating rocker 10 may be generated by any typical wind-up, spring-loaded crank that are well known in the art. A cover may be secured at housing 22 to cover power supply 24 and motor 14 to safely capture the power supply and motor and enhance the overall aesthetics of rocker 10. The cover may be secured to housing 10 in any number of configurations. For example, typical fasteners such as screws or nuts and bolts may be used. Also, typical snap in place features or a plastic latch device that may be molded as part of the cover and housing to facilitate easy removal of the cover from housing 22 without tools. All of the discussed securing methods, as well as others, are well known in the art.

Typically, seat rocker 10 may be manufactured of any type of plastic. A plastic material may be used when weight and ease of carrying seat rocker 10 is a consideration. Also, plastic or other materials that exhibit low friction forces may be used. The use of low friction materials may aid in sustaining a comfortable continuous rocking motion so as not to disturb the infant and to reduce the drag on motor 14 thus reducing operating costs of seat rocker 10. Specific types of plastics, such as polyethylene or polypropylene, may also reduce friction between tray 30 and seat rocker 10. While this particular embodiment has been described with plastic as a material for use in manufacturing seat rocker 10, it is important to note, however, that seat rocker 10 may be manufactured of any type of metal to further enhance durability of seat rocker 10 or any type of wood to add further decorative enhancements to seat rocker 10. Also, any combination of materials may be used to manufacture seat rocker 10.

Figure 9A:
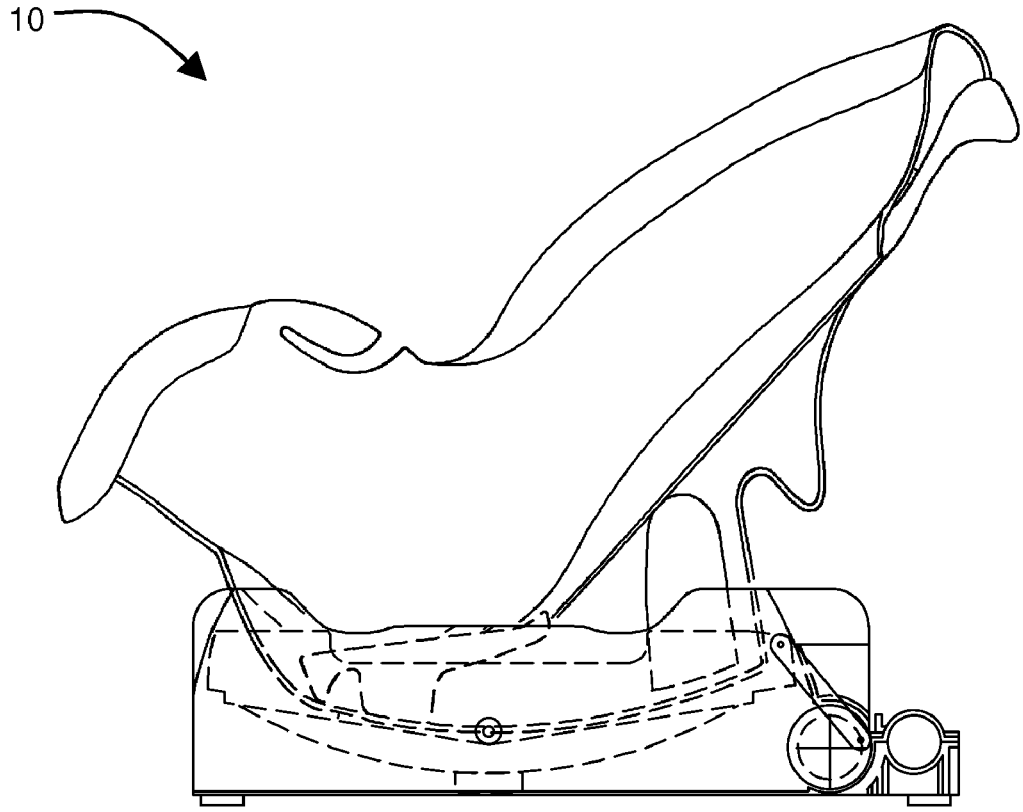
FIGS. 9A-9D are side views of the infant seat rocker according to an embodiment of the present invention illustrating various positions of an infant seat relative to the infant seat rocker.
Figure 9B:
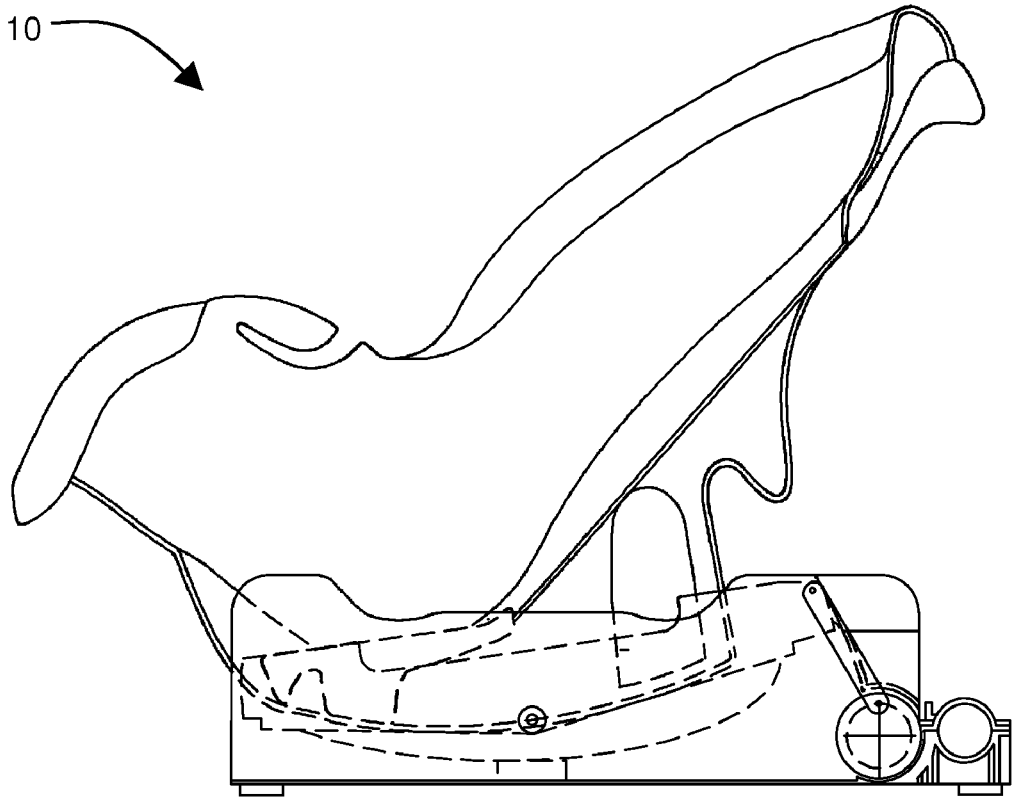
Figure 9C:
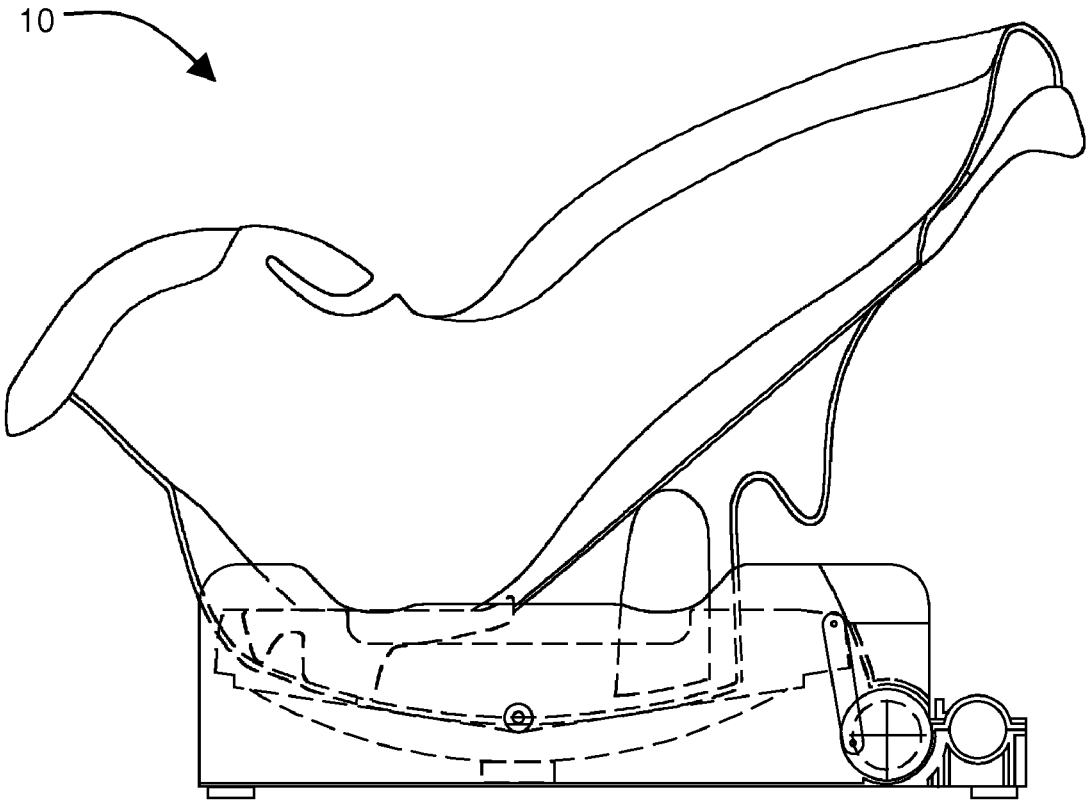
Figure 9D:
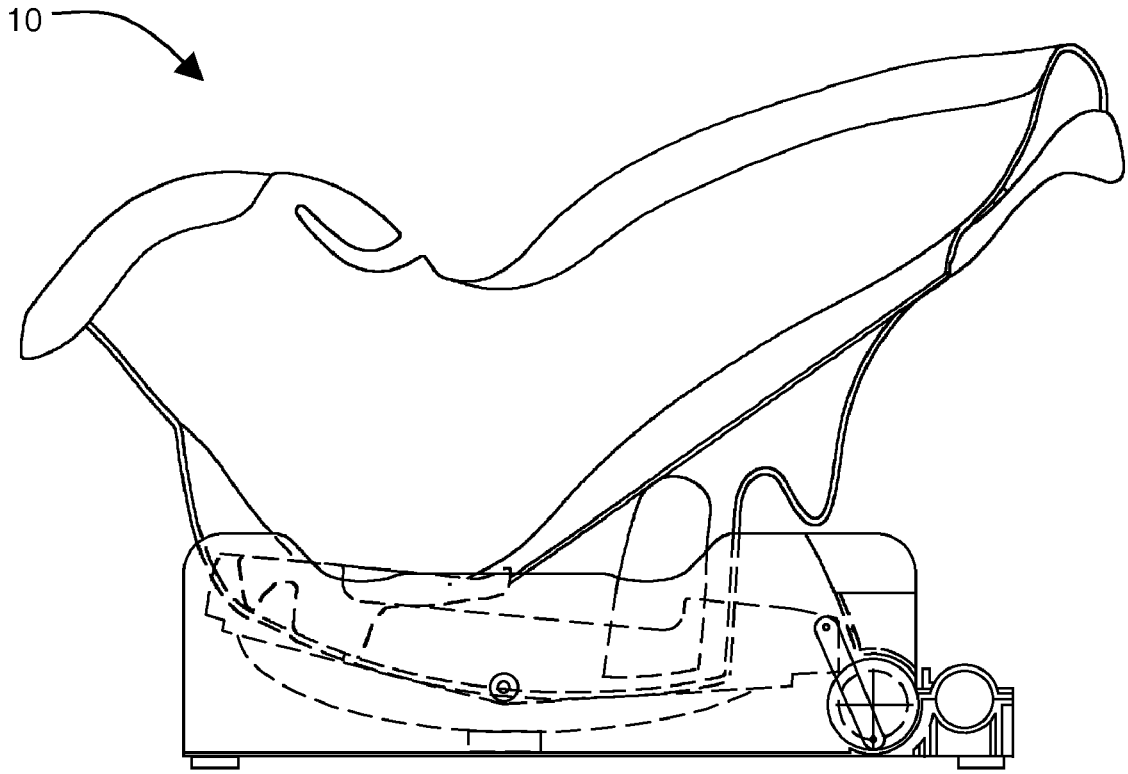

Referring now to FIGS. 9A-9D, infant seat 20 is shown in 3 different positions relative to infant seat rocker 10. FIGS. 9A and 9C illustrate infant seat 20 in a generally level position relative to seat rocker 10. Bar 16 is connected to a point on hub 60 that is generally level or parallel to support base 12 showing tray 30 and infant seat 20 in a generally level position relative to base 12 of rocker 10. FIG. 9B illustrates infant seat 20 in a tilted forward position relative to rocker 10. Bar 16 has now been pushed upward by hub 60, which in turn has tilted tray 30 and seat 20 forward. FIG. 9D illustrates infant seat 18 in a tilted rearward position relative to rocker 10. Bar 16 has now been pulled downward by hub 60, which in turn has pulled or tilted tray 30 and seat 20 rearward. It is important to note, however, FIGS. 9A-9D are merely illustrative of the possible positions and relationships of tray 30 seat 20, rocker 10, bar 16 and hub 60 and that seat 20 may be in any position relative to rocker 10.

Infant car seat rocker 10 may be available to consumers totally assembled and ready for use once the particular power supply is connected. Rocker 10 may be easily transported from location to location without the worry of assembly and disassembly prior to use. Rocker 10 may be sized to easily store under a bed or behind a coach when not in use or in a trunk, on the front seat of a vehicle or behind the front seat of a vehicle when in transit. Rocker 10 may also be sized to fit in the storage area of some strollers. Infant car seat rocker 10 is designed to induce and maintain a rocking motion in an infant car seat while at the same time keeping in mind the great benefits of being easily portable.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. An infant seat rocker comprising:

a base member;

a motor, said motor being positioned on said base member;

a tray member, said tray member positioned on said base member;

means for attaching said motor to said tray member;

at least one spring secured to said base member, said spring having a first end proximate a front wall of said tray member and a second end proximate a rear wall of said tray member;

a shaft, said shaft positioned to secure said tray member to said base member;

whereas an infant seat is positioned in said tray member; and whereas said motor is engaged to produce and maintain a rocking motion in the infant seat.

2. The infant seat rocker as recited in claim 1, wherein said attaching means is a rod.

3. The infant seat rocker as recited in claim 1, wherein said attaching means is a second spring.

4. The infant seat rocker as recited in claim 1, further including a power supply.

5. The infant seat rocker as recited in claim 4, wherein said power supply is at least one battery.

6. The infant seat rocker as recited in claim 4, wherein said power supply is adapted to draw power from a standard electrical wall socket.

7. The infant seat rocker as recited in claim 4, wherein said power supply is adapted to draw power from a standard vehicle power outlet.

8. The infant seat rocker as recited in claim 4, wherein said power supply is a wind-up mechanism.

9. The infant seat rocker as recited in claim 4, wherein said base further includes a housing, said housing sized to safely secure said motor and said power supply.

10. The infant seat rocker as recited in claim 1, wherein said base further includes a front wall that extends generally upward from a front of said base member and at least one rear wall that extends generally upward from a rear of said base member.

11. The infant seat rocker as recited in claim 1, wherein said base further includes a pair of side walls that extend generally upward from the sides of said base member.

12. The infant seat rocker as recited in claim 1, further including a plate, said motor being mounted to said plate and said motor being slideably adjustable about said plate relative to said base.

13. The infant seat rocker as recited in claim 1, wherein said motor includes a driveshaft;

a hub;

a dowel; and whereas the rocking arc of said tray member relative to said base member may be adjusted by changing the position of said dowel about said hub with respect to said driveshaft.

14. The infant seat rocker as recited in claim 1, wherein said tray member further includes a well, said well used to position and secure the infant seat to said infant seat rocker.

15. An infant seat rocker comprising:

a base member including a front wall that extends generally upward from a front of said base member, a rear wall that extends generally upward from a rear of said base member and a pair of side walls the extend generally upward from the sides of said base member;

a motor, said motor being positioned on said base member;

a power supply, said power supply connected to said motor;

a housing, said housing positioned at the rear of said base member and sized to safely secure said motor and said power supply;

a tray member, said tray member positioned on said base member;

a shaft, said shaft positioned to secure said base member to said tray member;

a first spring, said first spring positioned between said base member and said tray member;

a plate, said motor being mounted to said plate and said motor being slidably adjustable about said plate relative to said base member;

means for attaching said motor to said tray member;

whereas the infant seat is positioned in said tray member; and whereas said motor is engaged to produce and maintain a rocking motion in the infant seat.

16. The infant seat rocker as recited in claim 15, wherein said attaching means is a second spring.

17. The infant seat rocker as recited in claim 15, wherein said attaching means is a rod.

18. The infant seat rocker as recited in claim 15, wherein said power supply is at least one battery.

19. The infant seat rocker as recited in claim 15, wherein said power supply is adapted to draw power from a standard electrical wall socket.

20. The infant seat rocker as recited in claim 15, wherein said power supply is adapted to draw power from a standard vehicle power outlet.

21. The infant seat rocker as recited in claim 15, wherein said power supply is a wind-up mechanism.

22. The infant seat rocker as recited in claim 15, wherein said motor includes a driveshaft;

a hub;

a dowel; and whereas the rocking arc of said tray member relative to said base member may be adjusted by changing the position of said dowel about said hub with respect to said driveshaft.

23. The infant seat rocker as recited in claim 15, wherein said tray member further includes a well, said well used to position and secure the infant seat to said infant seat rocker.

24. A method for producing and maintaining a rocking motion in an infant seat comprising the steps of:

positioning the infant seat in a tray member;

securing the tray member to a base member;

connecting an attaching means between the tray member and a motor, the motor being positioned on a base member;

slideably positioning the motor relative to the tray member and the base member to increase or decrease the rocking arc of the tray member and infant seat relative to the base member; and energizing the motor to produce and maintain a rocking motion in the tray member, thereby inducing and maintaining a rocking motion in the infant seat.

25. The method as recited in claim 24, further comprising the step of positioning a dowel of the motor as close as possible to a driveshaft of the motor to decrease the rocking arc of the infant seat.

26. The method as recited in claim 24, further comprising the step of positioning a dowel of the motor as far as possible from a driveshaft of the motor to increase the rocking arc of the infant seat.

* * * * *